US005152236A

United States Patent [19]

Hirose

[11] Patent Number: 5,152,236

[45] Date of Patent: Oct. 6, 1992

[54] BOBBIN HOLDING STRUCTURE

[75] Inventor: Tokuzo Hirose, Hyogo, Japan

[73] Assignee: Hirose Manufacturing Company, Limited, Osaka, Japan

[21] Appl. No.: 626,288

[22] Filed: Dec. 12, 1990

[51] Int. Cl.[5] ..... D05B 57/26

[52] U.S. Cl. ..... 112/231

[58] Field of Search ..... 112/231, 229, 232, 181, 112/184, 228, 230; 242/130, 130.1, 130.2, 130.3, 130.4

[56] References Cited

U.S. PATENT DOCUMENTS

| | | | |
|---|---|---|---|
| 1,179,371 | 4/1916 | Diehl et al. | 112/228 X |
| 1,981,834 | 11/1934 | Fleckenstein | 112/231 |
| 2,763,227 | 9/1956 | Howard | 112/231 |
| 3,051,108 | 8/1962 | Ketterer | 112/229 X |
| 4,235,178 | 11/1980 | Ackermann | 112/229 |
| 4,429,649 | 2/1984 | Eguchi et al. | 112/229 |
| 4,453,479 | 6/1984 | Kawai | 112/231 |
| 4,676,178 | 6/1987 | Hirose | 112/231 |
| 4,679,513 | 7/1987 | Druffel | 112/231 X |

*Primary Examiner*—Werner H. Schroeder
*Assistant Examiner*—Paul C. Lewis
*Attorney, Agent, or Firm*—Wenderoth, Lind & Ponack

[57] ABSTRACT

A bobbin holding member magnetically adheres within a bobbin case holder which houses a bobbin. The bobbin is securely retained in the bobbin case holder without allowing the bobbin to be removed therefrom during a sewing operation. The bobbin holding member is installed in the bobbin case holder freely detachably, and thus the bobbin easily can be replaced.

12 Claims, 6 Drawing Sheets

BOBBIN HOLDING STRUCTURE

BACKGROUND OF THE INVENTION

1. Background of the Invention

The present invention relates to a bobbin holding structure to house and hold a bobbin in a bobbin case holder.

2. Description of the Prior Art

FIG. 1 is a perspective view of a typical prior art structure. FIG. 2 is a perspective view of a bobbin 5. FIG. 3 is a perspective view of a bobbin case 6 where the bobbin case 6 is shown partially cut away.

A horizontal axis full rotary looptaker 1 provided in a lock stitch sewing machine includes a rotating hook 3 driven by a rotary shaft 2 to rotate around a horizontal axis and a bobbin case holder 4 housed in the rotating hook 3. Bobbin case 6 housing bobbin 5 fits in the bobbin case holder 4. The bobbin case holder 4 is prevented from rotating by a rotation stopper member 7. When the rotary shaft 2 is rotated, the rotating hook 3 rotates around the rotary axis while the bobbin case holder 4 remains stationary.

FIG. 4 is a perspective view of the horizontal axis full rotary looptaker 1 with the bobbin 5 and the bobbin case 6 removed therefrom. FIG. 5 is a partially enlarged perspective view of the bobbin case 6. With reference made also to FIG. 1 through FIG. 3, a stud 9 projects perpendicularly from a bottom 8 of the bobbin case holder 4 to an open end thereof. As shown in FIG. 3, a hollow shaft 10 of straight cylindrical shape is positioned within the bobbin case 6. The hollow shaft 10 is inserted through a central hole or passage 11 of the bobbin 5, and the bobbin 5 is housed in the bobbin case 6. The bobbin case 6 which houses the bobbin 5 is housed in the bobbin case holder 4 with the stud 9 inserted through the hollow shaft 10.

When the bobbin 5 is within the bobbin case holder 4, a locking piece 13 which is provided on the bobbin case 6 is locked in a locking groove 12 which is formed at a free end of the stud 9, thereby locking the bobbin case 6 in the bobbin case holder 4. Thus, the bobbin 5 is retained in the bobbin case holder 4 by the bobbin case 6. In order to remove bobbin 5 from the bobbin case holder 4, a pivotable flap 14 is operated to release the lock between the locking piece 13 and the stud 9, and the bobbin case 6 then is removed from the bobbin case holder 4 and the bobbin 5 is removed from the bobbin case 6.

In such a prior art structure as described above, it takes substantial time to replace the bobbin, thereby resulting in poor productivity. Moreover, the mechanism for holding the bobbin is complicated.

SUMMARY OF THE INVENTION

An object of the invention is to provide a bobbin holding mechanism which makes it possible to easily attach and detach a bobbin in and from a bobbin case holder, and which is capable of securely holding the bobbin in the bobbin case holder by means of a simple structure.

The invention provides a bobbin holding mechanism where a bobbin holding member which attracts the bobbin to the bobbin case holder is mounted in a freely detachable manner.

In a preferred embodiment of the invention, the bobbin holding member has a bobbin thread tensioning function.

In another preferred embodiment of the invention, the bobbin thread tensioning function is achieved by a bobbin thread tensioner spring attached to the bobbin holding member.

The bobbin holding member holds the bobbin securely within the bobbin case holder without allowing the bobbin to detach from the bobbin case holder during a sewing operation. Since the bobbin holding member is installed detachably on the bobbin case holder, the bobbin easily can be replaced and the efficiency of the sewing operation can be improved.

In accordance to the invention, the bobbin is housed in the bobbin case holder securely by the bobbin holding member without allowing the bobbin to detach from the bobbin case holder. Because the bobbin holding member is freely detachable from the bobbin case holder, the bobbin easily can be removed from the bobbin case holder. This enables quick and easy replacement of the bobbin, resulting in improved efficiency. The bobbin holding mechanism of the invention can be employed in a conventional rotating hook, thus making it possible to use the invention widely in existing sewing machines.

The invention provides a bobbin holding mechanism comprising a body extending along a diameter of a bobbin case holder at an end face of an open end thereof and made of a ferromagnetic material. The body has at ends thereof recesses or slots to enable the end face to fit therein. A shaft extends perpendicularly from the center of the body in an axial direction and has a tip end that extends to near a bottom of the bobbin case holder when the body is installed on the bobbin case holder. A bobbin thread tensioner spring has a base end attached to the body and a free end with a bobbin thread guide slot and making elastic contact with a side face of the body. A screw member is provided on the bobbin thread tensioner spring and displaces the same toward or away from the body, thereby changing the pressure of the free end against the side face of the body. An attraction member of magnetic material is installed at the tip end of the shaft. The shaft is inserted through a cylinder of the bobbin and the attraction member is magnetically attracted to the bottom of the bobbin case holder, thus retaining the bobbin in the bobbin case holder.

In accordance to the invention, when the bobbin holding member is installed in the bobbin case holder, the body is disposed in the direction of the diameter of the bobbin case holder and the free end of the bobbin case holder fits in the slot, thereby preventing displacement of the direction of the diameter and ensuring the position of the body with respect to the bobbin case holder. The tip of the shaft extends to adjacent the bottom of the bobbin case holder, and the attraction member provided at the tip magnetically adheres to the bottom, thus retaining the bobbin in the bobbin case holder. This construction makes it possible to change the bobbin easily and quickly, thereby minimizing the time taken to change the bobbin and improving efficiency of a sewing operation. Also, because the body is equipped with the bobbin thread tensioner spring, the bobbin thread lead extending from the bobbin and that is retained in the bobbin case holder can be properly tensioned, thereby enabling the formation of stitches of good quality without allowing slack in the thread.

In accordance with the invention, the bobbin housed in the bobbin case holder can be securely retained therein by the bobbin holding member. Because the bobbin holding member is installed in the bobbin case holder in a freely detachable manner, the bobbin easily can be removed from the bobbin case holder. This makes it possible to replace the bobbin quickly with improved operating efficiency. The bobbin holding mechanism of the invention is simpler in construction than the bobbin cases of the prior art and therefore provides for better productivity and lower cost of manufacture. Moreover the bobbin holding mechanism of the invention makes possible the replacement of only the bobbin case holder unlike the rotating hooks of the prior art, and therefore can be employed with a wide range of rotating hooks in existing sewing machines.

BRIEF DESCRIPTION OF THE DRAWINGS

Other and further objects, features and advantages of the invention will be apparent from the following detailed description, taken with reference to the drawings, wherein.

DETAILED DESCRIPTION OF THE PREFERRED EMBODIMENTS

Figure 1:
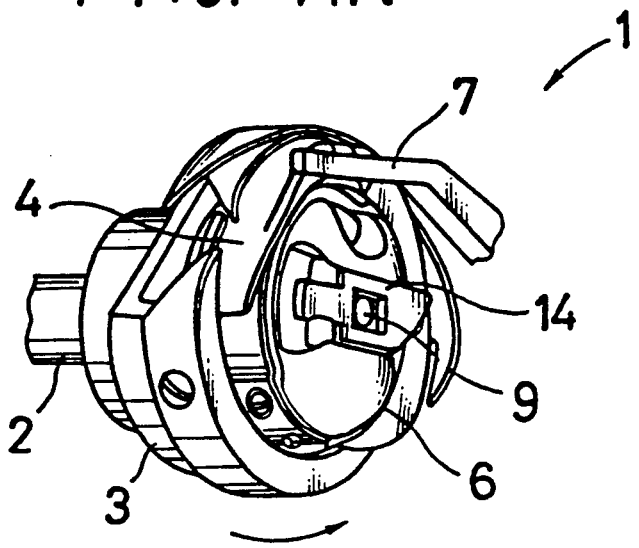
Fig. 1 Prior Art
FIG. 1 is a perspective view of a typical prior art structure.
Figure 2:
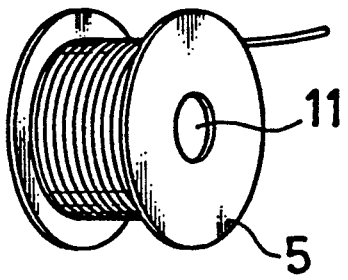
Fig. 2 Prior Art
FIG. 2 is a perspective view of a bobbin.
Figure 3:
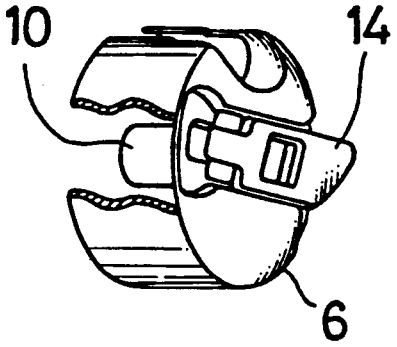
Fig. 3 Prior Art
FIG. 3 is a perspective view of a bobbin case.
Figure 4:
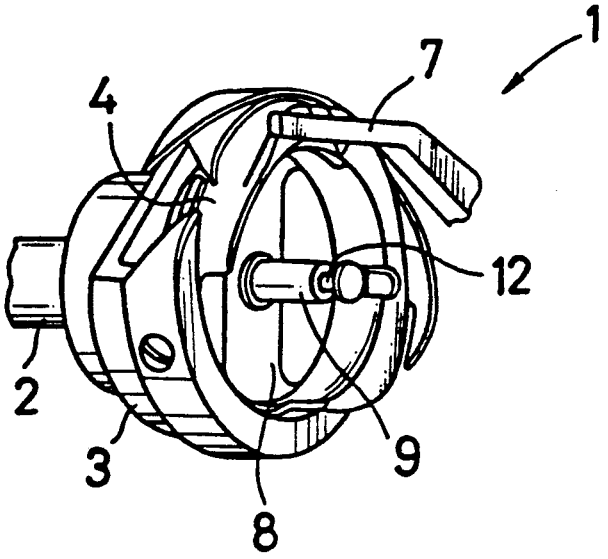
Fig. 4 Prior Art
FIG. 4 is a perspective view of a horizontal axis full rotary looptaker with the bobbin and the bobbin case removed therefrom.
Figure 5:
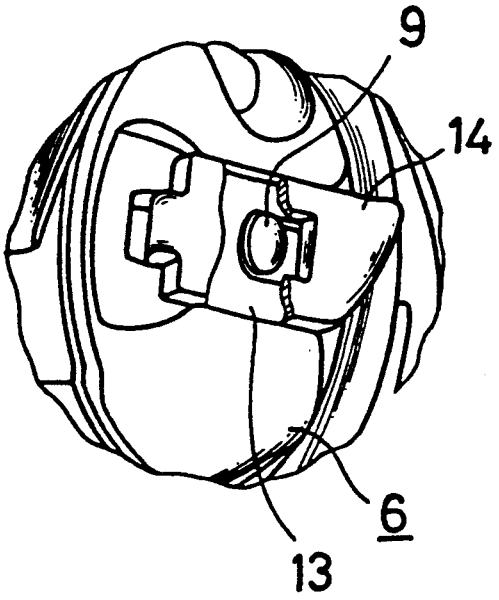
Fig. 5 Prior Art
FIG. 5 is a partially enlarged cross sectional view of the bobbin case.

Referring now to the drawings, preferred embodiment of the invention are described below.

Figure 6:
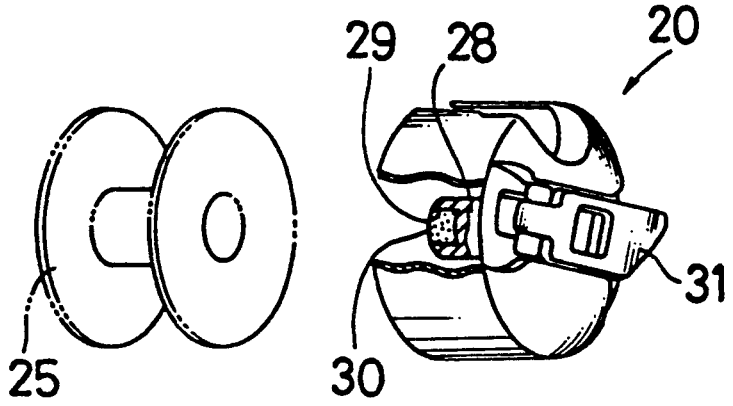
FIG. 6 is a perspective view of a bobbin holding member illustrative of a first embodiment of the invention.
Figure 7:
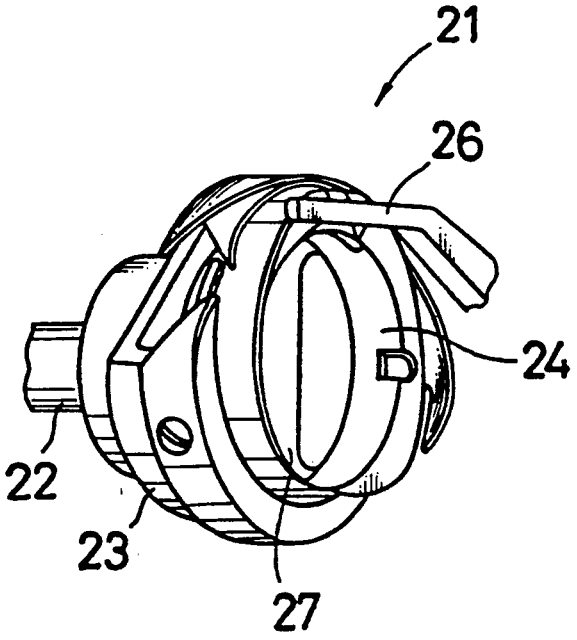
FIG. 7 is a perspective view of a horizontal axis full rotary looptaker equipped with the bobbin holding member.

FIG. 6 is a perspective view of a bobbin holding member 20 illustrative of an embodiment of the invention, and FIG. 7 is a perspective view of a horizontal axis full rotary looptaker 21 which is equipped with the bobbin holding member 20. In FIG. 6, the bobbin holding member 20 is shown partially cut away. The horizontal axis full rotary looptaker 21 to be installed in a lock stitch sewing machine is provided with a rotating hook 23 fixed to a rotary shaft 22 which is driven to rotate about a horizontal rotary axis. A bobbin case holder 24 made of a ferromagnetic material such as iron is housed in the rotating hook 23, and the bobbin holding member 20 with a bobbin 25 housed therein is installed in the bobbin case holder 24.

A rotation stopper 26 prevents the bobbin case holder 24 from rotating when the rotating hook 23 is rotated about the rotary axis thereof. In this embodiment, a bottom 27 of the bobbin case holder 24 is flat because it is not necessary to provide a stud 9 as required in the above described prior art structure.

The bobbin holding member 20 has a cylindrically shaped shaft 28 which extends along a center axis thereof. Formed at a tip of the shaft 28 is a recess 29 having fixed therein an attraction member 30 made of a magnetic material, e.g. a permanent magnet. By housing the bobbin 25 in such a bobbin holding member 20 and installing it in the bobbin case holder 24, the bobbin 25 can be retained securely in the bobbin case holder 24 by the magnetic attraction of the attraction member 30 to the bottom 27. The bobbin 25 easily can be removed from the bobbin case holder 24 by picking up the bobbin holding member 20 and removing it from the bobbin case holder 24.

In another embodiment, installation of a cylindrical attraction member in hollow shaft 10 of the conventional bobbin case 6 makes it possible to use the conventional bobbin case holder 4. As such, the invention widely may be employed with existing rotating hooks.

Figure 8:
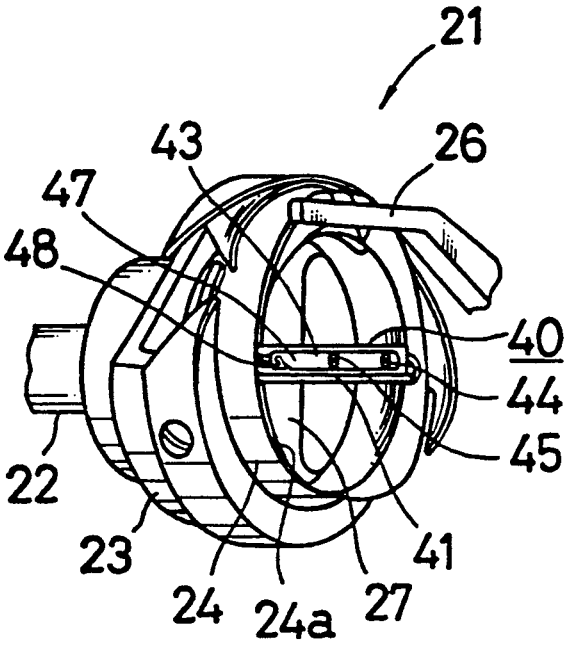
FIG. 8 is a perspective view of a bobbin holding member illustrative of a second embodiment of the invention.
Figure 9:
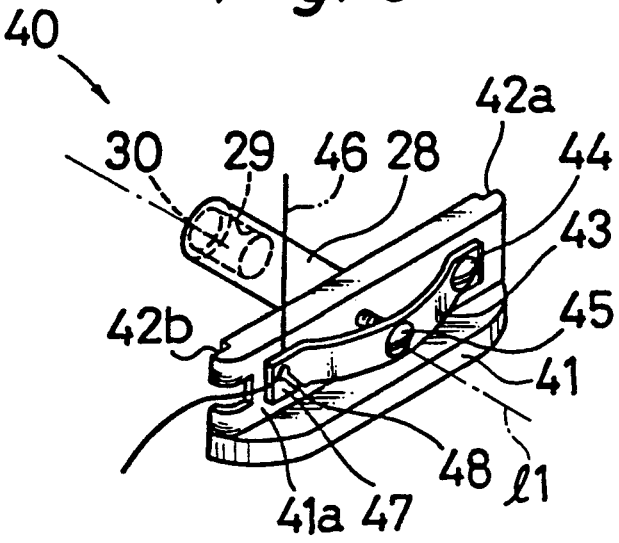
FIG. 9 is an enlarged perspective view of such bobbin holding member.
Figure 10:
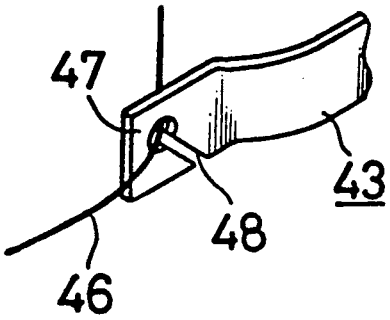
FIG. 10 is a partially enlarged perspective view of a bobbin thread tensioner spring.

FIG. 8 is a perspective view of a bobbin holding member 40 installed in the horizontal axis full rotary looptaker 21 according to a second embodiment of the invention. FIG. 9 is an enlarged perspective view of the bobbin holding member 40. FIG. 10 is a partially enlarged perspective view of a bobbin thread tensioner spring 43. Parts which correspond to those of the embodiment mentioned above are designated by like reference numerals. The bobbin holding member 40 of the second embodiment includes a body 41 in the form of an elongated bar which is installed at an end face 24*a* of the bobbin case holder 24 at an axially open end thereof and extends in the direction of the diameter thereof, and a shaft 28 extending perpendicularly from the center of the body 41 in axial direction of bobbin case holder 24.

The body 41 has at opposite ends thereof fitting slots 42*a*, 42*b* to accommodate the end face 24*a* of the bobbin case holder 24. Thus, it is possible to install the bobbin holding member 40 in the bobbin case holder 24 so that the axis of shaft 28 is coaxial with the center axis of the bobbin case holder. Bobbin thread tensioner 43 has a curved plate shape and has a base end section thereof fixed to body 41 by a screw 44.

An adjustment screw 45 freely passes axially through the center of the bobbin thread tensioner spring 43 and is threaded into a screw hole formed in the body 41. Formed at a free end of the bobbin thread tensioner spring 43 is a pressurizing portion 47 which makes elastic contact with one side 41*a* of the body 41 and pressurizes a bobbin thread 46. A bobbin thread guiding slot 48 is formed in portion 47, as shown in FIG. 10. The bobbin thread 46 is passed through the bobbin thread guiding slot 48, and is elastically pressed against the side face 41*a* by the pressurizing portion 47.

By turning the adjustment screw 45 in opposite directions, the force acting on the bobbin thread can be adjusted. Therefore, it is possible to apply a proper tension, by the rotary action of the rotating hook 23, to the bobbin thread 46 removed from the bobbin 25, thereby ensuring a sewing operation conducted with a desired thread tension.

Figure 11:
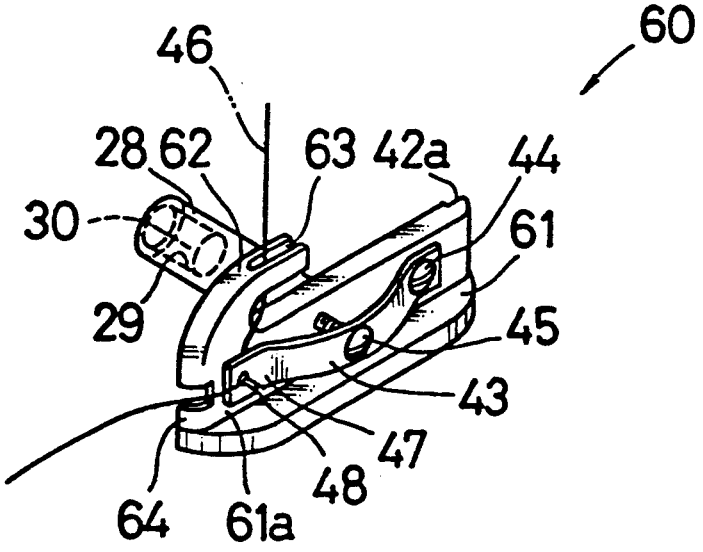
FIG. 11 is a perspective view of a bobbin holding member illustrative of a third embodiment of the invention.

FIG. 11 is a perspective view of a bobbin holding member 60 illustrative of the third embodiment of the invention. A body 61 of the bobbin holding member 60 has integrally formed therewith a bobbin thread guiding member 62. The bobbin thread guiding member 62 has formed therein a notch 63 through which fits the bobbin thread 46. The bobbin thread 46 removed from the bobbin 25 passes through the bobbin thread guiding slot 48, is elastically pressed by the pressurizing portion 47 against a side face 61*a* of the body 61, and is passed through the notch 63. This constitution it is possible to retain the bobbin 25 in the bobbin case holder 24 and, by applying a desired tension to the bobbin thread 46, to remove the bobbin with the desired thread tension. Because the fitting slot 42*b* (FIG. 9) described in relation to the previous embodiment is not formed in this embodiment, the bobbin holding member 60 may be magnetically attracted to the end face 24*a* of the bobbin case holder 24 by magnetizing the body 61 adjacent a portion or end 64 thereof. By such arrangement, the bobbin holding member 60 can be installed securely without lateral displacement thereof relative to the end face 24*a* of the bobbin case holder 24 during a sewing operation.

Figure 12:
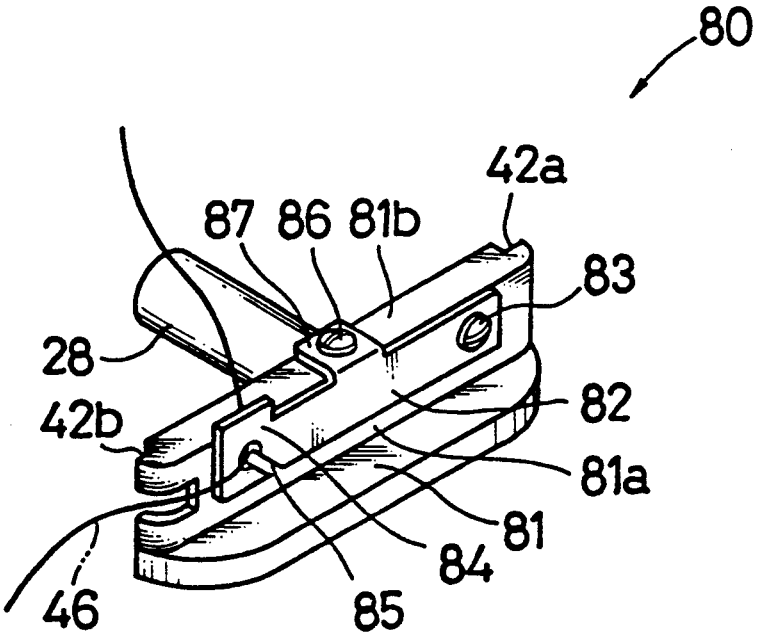
FIG. 12 is a perspective view of a bobbin holding member illustrative of a fourth embodiment of the invention.

FIG. 12 is a perspective view of a bobbin holding member 80 illustrative of the fourth embodiment of the invention. A bobbin thread tensioner spring 82 is installed by a set screw 83 on a base end section of a body 81 of the bobbin holding member 80. The body 81 is made of a magnetic material so that the bobbin thread tensioner spring 82 is magnetically attracted and thereby presses the bobbin thread 46 against a side face 81*a*. Formed at a free end of the bobbin thread tensioner spring 82 is a pressurizing portion 84 having formed therein a bobbin thread guiding slot 85. Formed between the base end section and the free end section of the bobbin thread tensioner spring 82 is a mounting section 87 through which is threaded an adjustment screw 86. A tip end of the screw 86 is in contact with a top face 81*b* of the body 81. By turning screw 86 in opposite directions, it is possible to displace bobbin thread tensioner spring 82 angularly about the set screw 83, thus changing the length of the bobbin thread 46 is interposed between the pressurizing portion 84 and the side face 81*a* of the body 81. When such length is increased a friction force applied to the bobbin thread is increased, and when such length is decreased the friction force is decreased. This makes it possible to apply a proper tension to the bobbin thread 465 to perform a sewing operation at a desired thread tension.

As described above, by means of the bobbin holding members 20, 40, 60 and 80 in accordance with the invention, it is possible to apply a proper tension to the bobbin thread removed from the bobbin 25 and perform a sewing operation at a desired thread tension.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A bobbin holding mechanism for detachably mounting a bobbin in a bobbin case holder including a bottom of ferromagnetic material and having an open end, said mechanism comprising:

a body member in the form of a bar to be mounted at the open end of the bobbin case holder and having opposite ends, at least one of said ends having therein a slot for receiving the open end of the bobbin case holder such that said body member when mounted will extend in a direction of a diameter of the bobbin case holder;

a shaft extending perpendicularly from a center of said body member in an axial direction of the bobbin case holder when said body member is mounted thereon, said shaft having a tip end positioned adjacent the bottom of the bobbin case holder when said body member is mounted thereon;

an attraction member located at said tip end of said shaft and formed of magnetic material;

whereby when a bobbin is mounted in the bobbin case holder, said shaft is passed through a center opening of the bobbin, said body member is positioned at the open end of the bobbin case holder, and magnetic attraction between said attraction member and the bottom of the bobbin case holder retains said body member in position and the bobbin within the bobbin case holder;

a bobbin thread tensioner spring having a base end mounted on said body member and a free end elastically abutting said body member, said free end having therein a thread guide slot through which passes a bobbin thread when a bobbin in mounted in the bobbin case holder; and an adjusting screw member extending through said tensioner spring for moving said tensioner spring relative to said body member and thereby adjusting the tension applied to a bobbin thread passing through said thread guide slot.

2. A mechanism as claimed in claim 1, wherein both of said opposite ends of said body member have therein respective slots for receiving the open end of the bobbin case holder.

3. A mechanism as claimed in claim 1, wherein said end of said body member opposite said slot includes means for causing said opposite end to be magnetically attracted to the open end of the bobbin case holder.

4. A mechanism as claimed in claim 1, wherein one of said ends of said body member has extending therefrom an integral bobbin thread guiding member having therein a notch for the passage therethrough of a bobbin thread.

5. A mechanism as claimed in claim 1, wherein said tip end of said shaft has therein a recess, and said attraction member is positioned in said recess.

6. A mechanism as claimed in claim 1, wherein said attraction member comprises a permanent magnet.

7. A bobbin holding structure comprising:

a bobbin case holder including a bottom of ferromagnetic material and having an open end;

a body member in the form of a bar to be mounted at the open end of the bobbin case holder and having opposite ends, at least one of said ends having therein a slot for receiving the open end of the bobbin case holder such that said body member when mounted will extend in a direction of a diameter of the bobbin case holder;

a shaft extending perpendicularly from a center of said body member in an axial direction of said bobbin case holder when said body member is mounted thereon, said shafts having a tip end positioned adjacent the bottom of said bobbin case holder when said body member is mounted thereon;

an attraction member located at said tip end of said shaft and formed of magnetic material;

whereby when a bobbin is mounted in said bobbin case holder, said shaft is passed through a center opening of the bobbin, said body member is positioned at the open end of said bobbin case holder, and magnetic attraction between said attraction member and said bottom of said bobbin case holder retains said body member in position and the bobbin within said bobbin case holder;

a bobbin thread tensioner spring having a base end mounted on said body member and a free end elastically abutting said body member, said free end having therein a thread guide slot through which passes a bobbin thread when a bobbin is mounted in the bobbin case holder; and an adjusting screw member extending through said tensioner spring for moving said tensioner spring relative to said body member and thereby adjusting the tension applied to a bobbin thread passing through said thread guide slot.

8. A structure as claimed in claim 7, wherein both of said opposite ends of said body member have therein respective slots for receiving said open end of said bobbin case holder.

9. A structure as claimed in claim 7, wherein said end of said body member opposite said slot is magnetically attracted to said open end of said bobbin case holder.

10. A structure as claimed in claim 7, wherein one of said ends of said body member has extending therefrom an integral bobbin thread guiding member having therein a notch for the passage therethrough of a bobbin thread.

11. A structure as claimed in claim 7, wherein said tip end of said shaft has therein a recess, and said attraction member is positioned in said recess.

12. A structure as claimed in claim 7, wherein said attraction member comprises a permanent magnet.

* * * * *